US008415598B1

(12) United States Patent
Terhune et al.

(10) Patent No.: US 8,415,598 B1
(45) Date of Patent: Apr. 9, 2013

(54) EXTENDABLE FINS FOR A TUBE-LAUNCHED PROJECTILE

(75) Inventors: Robert Terhune, Budd Lake, NJ (US); Michael Hollis, Flanders, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 186 days.

(21) Appl. No.: 12/973,074

(22) Filed: Dec. 20, 2010

(51) Int. Cl.
*F42B 10/14* (2006.01)
*F42B 10/20* (2006.01)

(52) U.S. Cl. ..... 244/3.28; 244/3.27; 102/490; 102/524

(58) Field of Classification Search ..... 244/3.24, 244/3.27, 3.28, 3.29, 49, 63, 473; 102/400, 102/473, 490, 517, 524, 526; 89/14.6, 1.8; *F42B 10/00, 10/14, 10/20*
See application file for complete search history.

(56) References Cited

U.S. PATENT DOCUMENTS 3,819,132 A * 6/1974 Rusbach ..... 244/3.28
3,880,383 A * 4/1975 Voss et al. ..... 244/3.27
4,175,720 A * 11/1979 Craig ..... 244/3.28
5,040,746 A * 8/1991 Mikhail ..... 244/3.27
5,082,203 A * 1/1992 Baubry ..... 244/3.28
8,253,085 B1 * 8/2012 Lichtenberg-Scanlan et al. ..... 244/3.27
2005/0082419 A1 * 4/2005 Dryer et al. ..... 244/3.3

* cited by examiner

*Primary Examiner* — Peter M. Poon
*Assistant Examiner* — Timothy Schwarz
(74) *Attorney, Agent, or Firm* — Michael C. Sachs

(57) ABSTRACT

A stabilizing fin deployment apparatus may include a base assembly for attachment to the rear end of a projectile. The base assembly may include a base, a spacer, a fin mount, a gas cavity and an opening that extends from the rear end of the base to the gas cavity. A retention nut may engage the base and secure the fin mount and spacer to the base. A retention plug may be disposed in the opening in the base assembly. The retention plug may include at least one gas conduit between an outer surface of the retention plug and the gas cavity. A retention bolt may extend through the retention plug and may be fixed to the base. A plurality of fins hubs may be rotatably fixed to the base. A plurality of fins may be translatably connected to the fin hubs. When deployed, the fin hubs may rotate forward and the fins may translate outward far into the airstream.

20 Claims, 15 Drawing Sheets

38
5D
5D
24
42
26
44
26

5B
42
38
24
28
26
26
5B 38
42
42
44
26

EXTENDABLE FINS FOR A TUBE-LAUNCHED PROJECTILE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to ballistic munitions and in particular to fin-stabilized ballistic projectiles.

Military organizations have a growing demand for precision guided munitions. In contrast to traditional spin-stabilized ballistic munitions, a fin-stabilized projectile relies on fins in its base to sustain stability and maneuverability during flight. Deploying fins on a projectile from a tube-launched environment is a difficult task requiring much engineering design and analysis. A projectile experiences high loads and large accelerations during a ballistic gun launch. Upon exiting the muzzle, the projectile needs a simple and reliable fin deployment method.

In addition to the gun launch and deployment constraints, fins also must perform their intended function of maintaining aeroballistic stability of the projectile. Maintaining stability requires the fins to have a specific geometry and method of intrusion into the airstream. The fins must obtain a specific center of pressure for aeroballistic stability and maneuverability over the entire flight mission.

A need exists for a reliable fin deployment method and apparatus that maintains the aeroballistic stability of a projectile.

SUMMARY OF THE INVENTION

It is an object of the invention to provide a reliable fin deployment method and apparatus that maintains the aeroballistic stability of a projectile.

One aspect of the invention is a projectile that may include a body and a base assembly fixed to a rear end of the body. The base assembly may include a base, a spacer, a fin mount, a gas cavity and an opening extending from a rear end of the base to the gas cavity. A retention nut may be engaged with the base. The retention nut may secure the fin mount and spacer to the base. A retention plug may be disposed in the opening in the base assembly. The retention plug may include at least one gas conduit between an outer surface of the retention plug and the gas cavity. A retention bolt may extend through the retention plug and may be fixed to the base.

A plurality of fins hubs may be rotatably fixed to the base. Each fin hub may include a yoke. A plurality of fins may be movably connected to respective ones of the plurality of fin hubs. Each fin may include a slot formed therein. Each fin may be inserted in the yoke of a respective fin hub and connected to the respective fin hub by fasteners movably disposed with respect to the slot and fixed to the yoke. The plurality of fin hubs and fins may have a stowed position and a deployed position.

A retention disk may be disposed in openings in each of the plurality of fins. The retention disk may be fixed in place by the retention bolt.

Each slot may include a central portion that is substantially parallel to a longitudinal axis of the projectile when the fins are in the stowed position, and front and rear portions that are substantially perpendicular to the central portion. With respect to the longitudinal axis of the projectile, the rear portion of each slot may be radially distant from the front portion of each slot.

The number of the fasteners that movably connect each fin to each fin hub may be two. In the stowed position of the fins, a first of the two fasteners may be disposed in the rear portion of the slot and a second of the two fasteners may be disposed in the central portion of the slot. In a deployed position of the fins, the first of the two fasteners may be disposed in the central portion of the slot and the second of the two fasteners may be disposed in the front portion of the slot.

The retention disk may include a plurality of slots formed therein. When the fins are in the stowed position, a portion of each fin may be disposed in a respective one of the slots.

An obturator groove may be formed in the base. A rear side of the obturator groove may be defined by the spacer.

A spring lever may be disposed in each yoke. The spring lever may have one end fixed to the fin hub and a free end. Each fin may include a notch formed on a front surface. The free end of the spring lever may be disposed in the notch when the fin is in the deployed position.

Another aspect of the invention is a method that may include providing a projectile, igniting propellant, and filling a gas cavity in a base assembly of the projectile with gas produced by combustion of the propellant. When the projectile exits the gun tube, the method may include fracturing a retention bolt and moving a retention plug out of an opening in the base assembly. The method may include moving fin hubs to a deployed position and translating fins with respect to the fin hubs.

Moving the fin hubs to the deployed position may include rotating the fin hubs with respect to a fin mount and not translating the fin hubs with respect to the fin mount. After moving the fin hubs and translating the fins, the fin hubs and the fins may be locked in the deployed position. Translating the fins may include moving two fasteners through a slot.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A fin deployment apparatus may support the rear fins of a projectile. A fin deployment apparatus may maintain the rear fins in a stowed configuration until the entire projectile has exited the gun tube muzzle. After exiting the muzzle, a fin deployment apparatus may function by using the differential pressure between a pressurized gas cavity of the fin deployment apparatus and the atmosphere surrounding the fin deployment apparatus. The differential pressure may shear a bolt and/or push a plug out of and away from a base, thereby releasing and deploying the stabilizing fins. The plug may have an aerodynamic shape to ensure that it does not return to the gun site and inflict damage to the crew or equipment.

Once released, the fins may then mechanically lock at a desired angle from the base. It may be necessary for the fins to be released simultaneously due to the naturally marginal level of stability in some precision artillery. The marginal stability may be required to ensure adequate maneuverability of the projectile throughout its flight and in its terminal flight phase.

Figure 1:
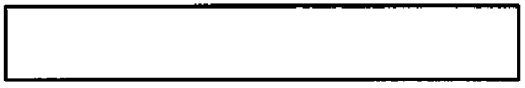
Fig. 1 Prior Art
FIG. 1 is a schematic drawing of a gun tube for launching a projectile having a fin deployment apparatus.

FIG. 1 is a schematic drawing of a gun tube 100 for launching a projectile having a fin deployment apparatus. Gun tube 100 may be, for example, an artillery tube, a tank barrel, etc.

Figure 2:
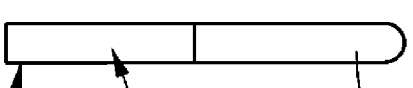
FIG. 2 is a schematic drawing of a cartridge and a projectile having a fin deployment apparatus.

FIG. 2 is a schematic view of a projectile 10 seated in a cartridge 102. Cartridge 102 may contain propellant 104.

Figure 3:
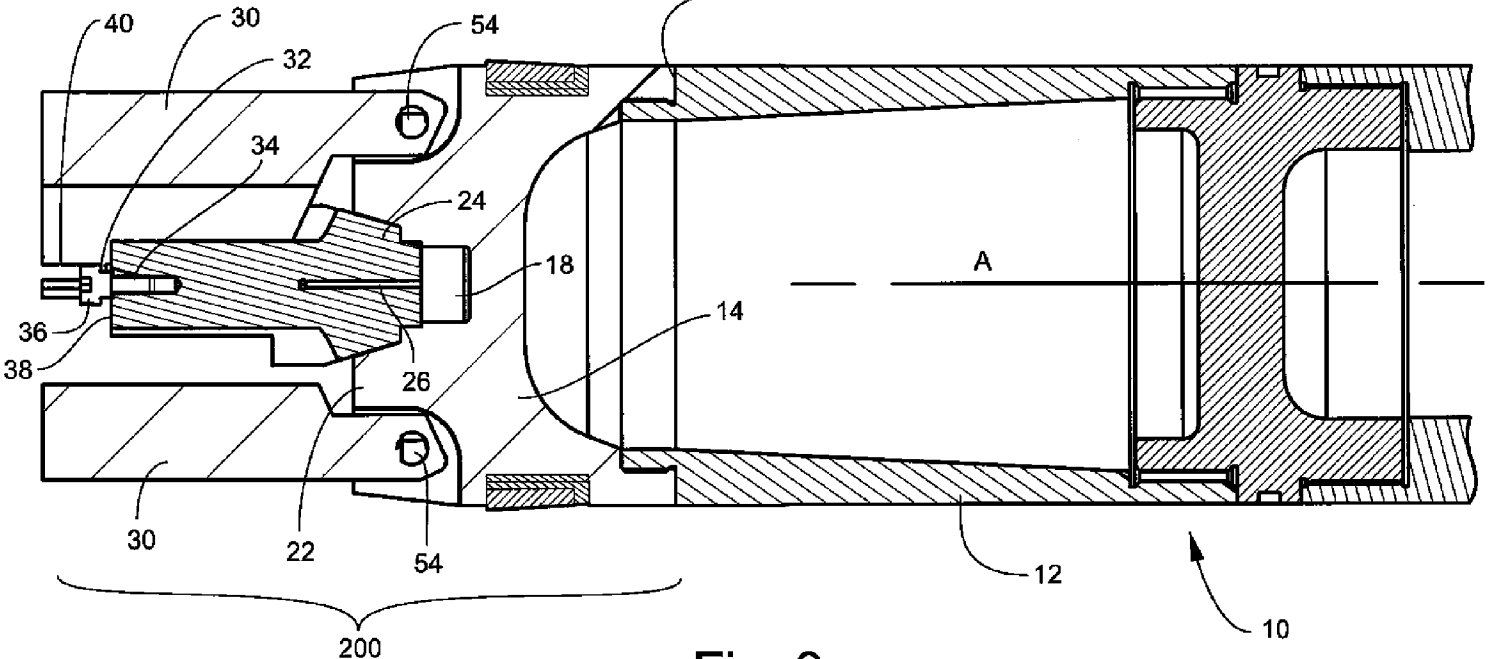
FIG. 3 is an enlarged, sectional view of the rear portion of an embodiment of a projectile with a fin deployment apparatus.
Figures 4A, 4B:
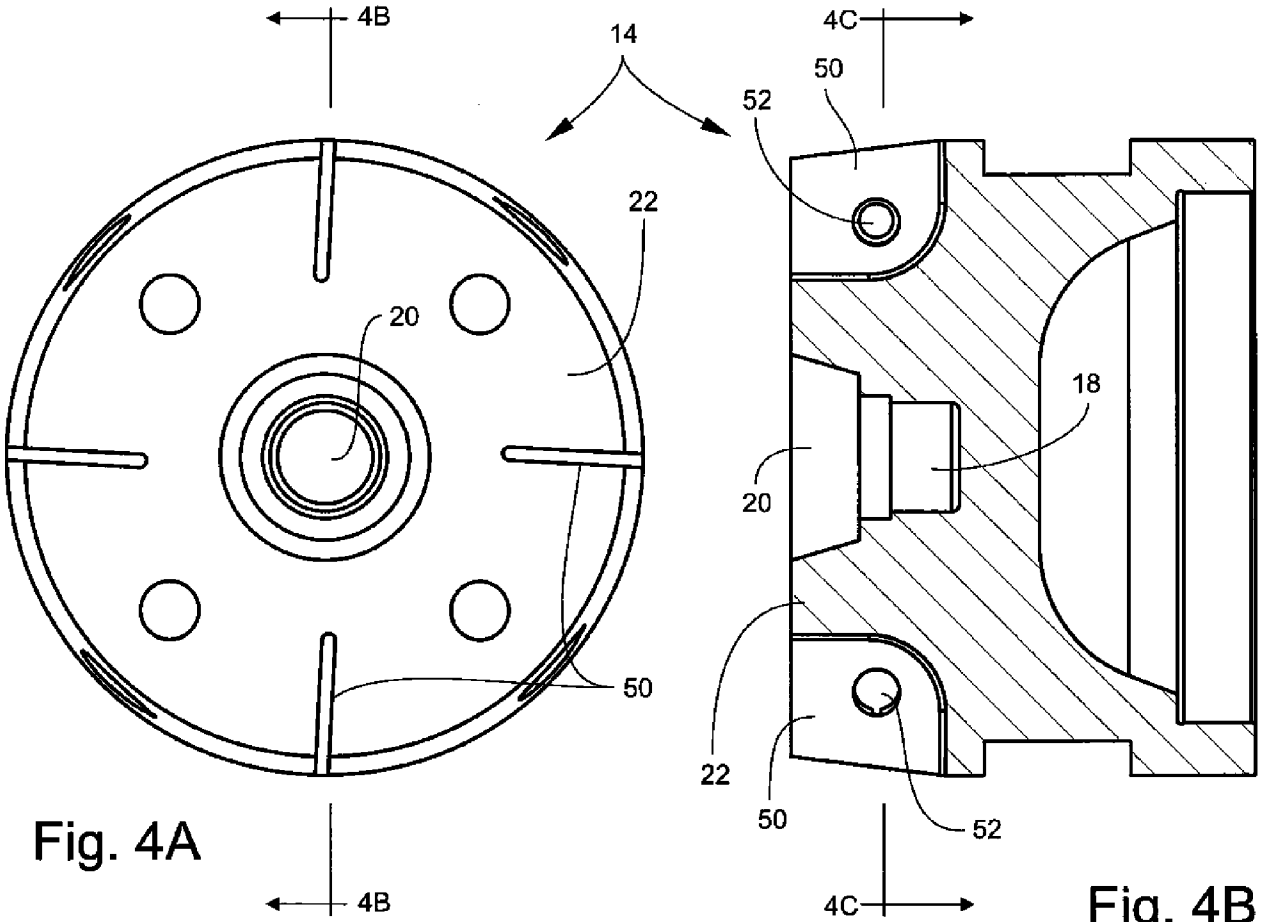
FIG. 4A is a rear view of an embodiment of a base for a fin deployment apparatus.
FIG. 4B is a sectional view along the line 4B-4B of FIG. 4A.
Figure 4C:
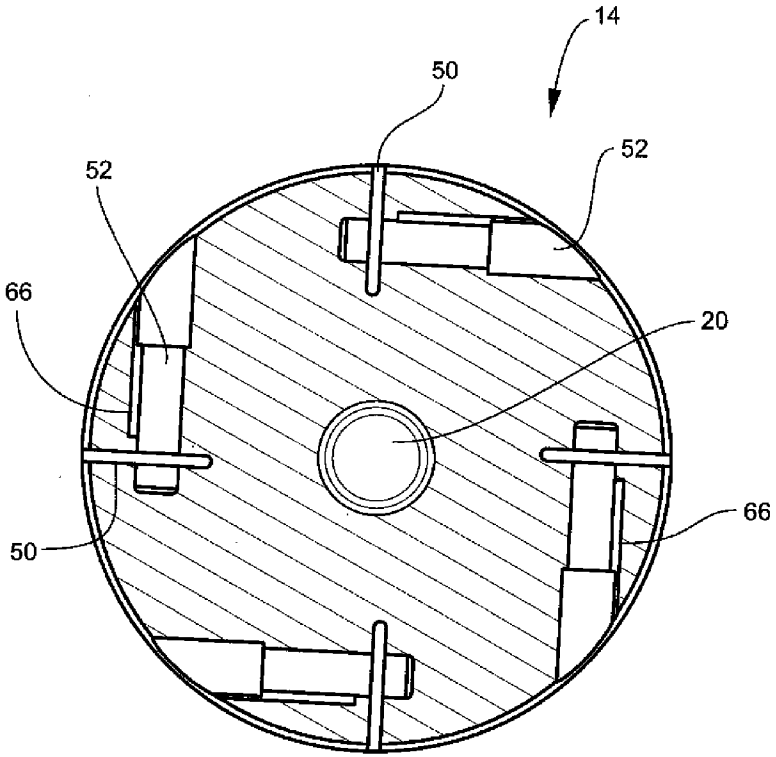
FIG. 4C is a sectional view along the line 4C-4C of FIG. 4B.

FIG. 3 is an enlarged, sectional view of the rear portion of an embodiment of a projectile 10 with a fin deployment apparatus 200. Projectile 10 may have a longitudinal axis A and a body 12. Fin deployment apparatus 200 may include a base 14 fixed to a rear end 16 of body 12. Base 12 may include a gas cavity 18 and an opening 20 (See FIGS. 4A-C) extending from a rear end 22 of base 14 to gas cavity 18. A retention plug 24 (FIG. 3) may be disposed in opening 20.

Figures 5A, 5B, 5C, 5D:
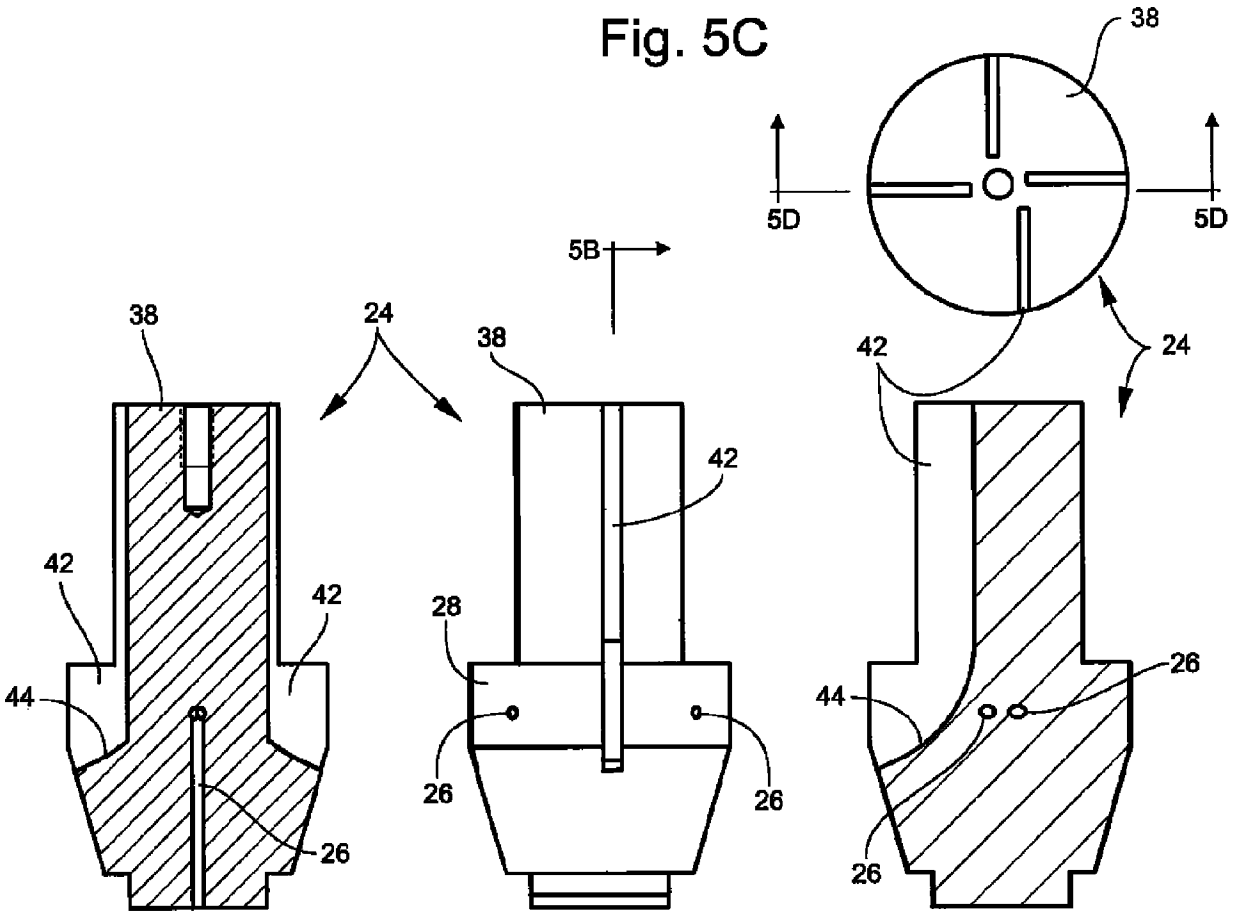
FIG. 5A is a perspective view of an embodiment of a retention plug for a fin deployment apparatus.
FIG. 5B is a sectional view along the line 5B-5B of FIG. 5A.
FIG. 5C is a top view of the plug of FIG. 5A.
FIG. 5D is a sectional view along the line 5D-5D of FIG. 5C.

A fit between retention plug 24 and opening 20 may be such that propellant gas pressure in gas cavity 18 forces retention plug 24 out of opening 20. For example, the fit between plug 24 and opening 20 may be a press type of fit with an overlap of, for example, about 0.001 inches. Retention plug 24 may include at least one gas conduit 26 (see also FIGS. 5A-D) between an outer surface (FIG. 5A) of retention plug 24 and gas cavity 18. In one embodiment, there may be four gas conduits 26 spaced about ninety degrees apart.

After ignition of propellant 104 (FIG. 2), the high pressure propellant gases may fill gas cavity 18 via conduits 26 before projectile 10 exits gun tube 100. The pressure of the propellant gases in tube 100 may be, for example, about 20,000 psi. When projectile 10 exits tube 100, the high pressure gas in cavity 18 may force plug 24 out of opening 20. Movement of plug 24 rearwardly causes fins 30 to rotate open, as will be explained in more detail.

Figure 6:
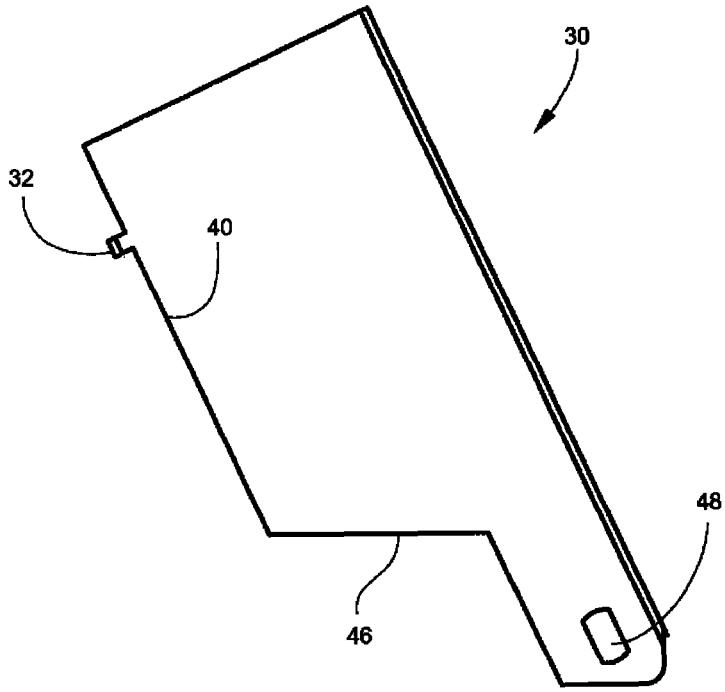
FIG. 6 is a side view of an embodiment of a fin.
Figure 9:
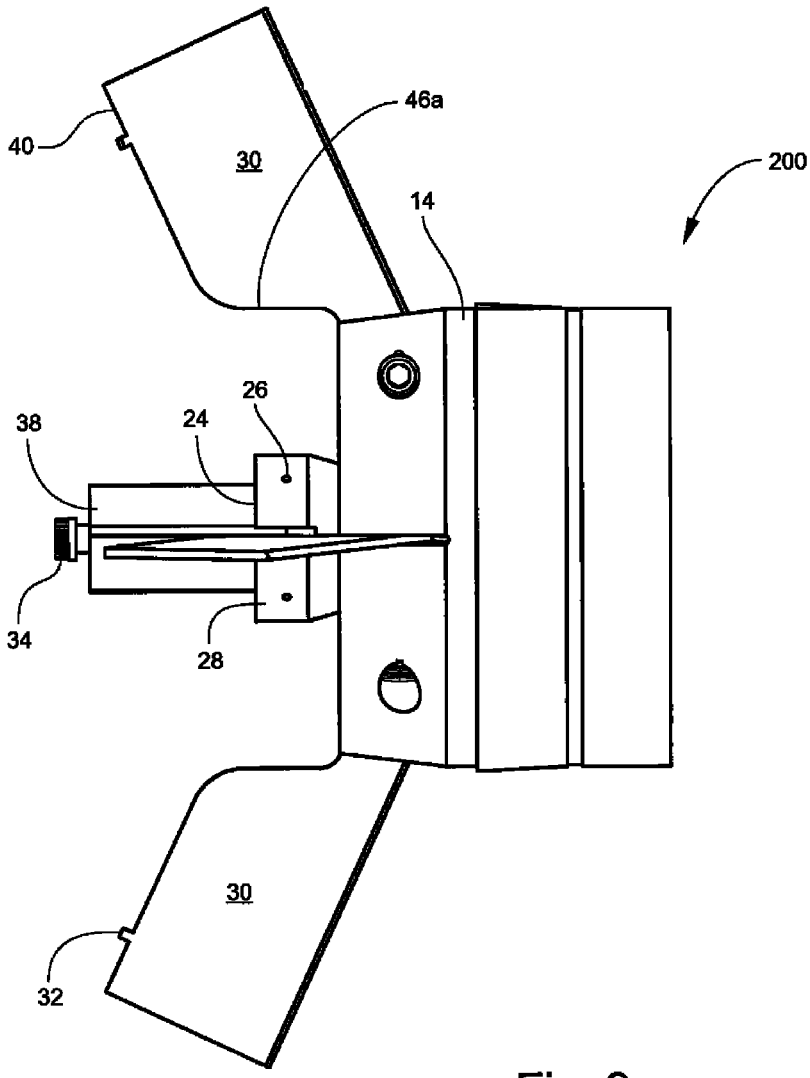
FIG. 9 is a side view of an embodiment of a fin deployment apparatus with the fins in a deployed position.

A plurality of fins 30 may be rotatably fixed to base 14. Fins 30 may comprise, for example, steel. Fins 30 may have a folded position, as in FIG. 3, and a deployed position, as in FIG. 9. Each fin 30 may include a tab 32 (FIG. 6) disposed on an inner edge 40 of the fin 30. Each fin 30 may include an opening 48 for receiving a fin shaft 54.

Fins 30 may be maintained in the folded position with a retention screw 34 (FIG. 3) that may interact with tabs 30. Retention screw 34 may be adjustably disposed in a rear end 38 of retention plug 24. For example, retention screw 34 may be threaded into rear end 38 of plug 24. Retention screw 34 may include a head 36.

In the position shown in FIG. 3, tabs 32 may be disposed beneath (forward of) head 36. Retention screw 34 may be threaded inwardly to bear against tabs 32 and thereby maintain fins 30 in the folded position. A gap may exist between forward edges of tabs 30 and rear end 38 of plug 24. The gap allows the fins 30 to be unlocked as plug 24 and retention screw 34 move rearward after projectile 10 exits gun tube 100.

Retention plug 24 may include a plurality of slots 42 (FIGS. 5A-5D) formed therein. When fins 30 are in the folded position, a portion of each fin 30 may be disposed in a respective one of the slots 42. A forward edge 44 of each slot 42 may be curvilinear. A forward edge 46 (FIG. 6) of each fin 30 may be linear. Alternatively, a forward edge 46*a* (FIG. 9) of each fin 30 ma be curved.

Figure 7B:
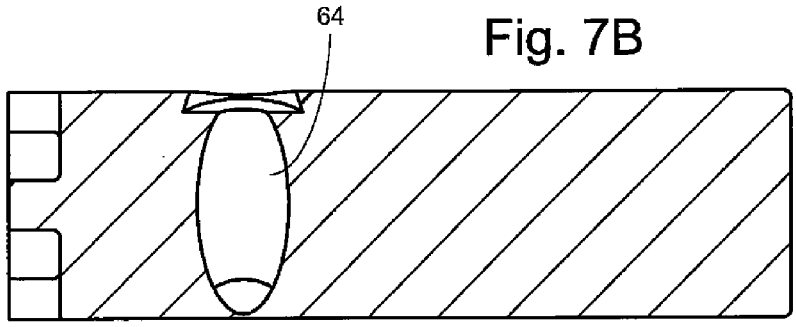
FIG. 7B is a sectional view along the line 7B-7B of FIG. 7A.
Figure 7A:
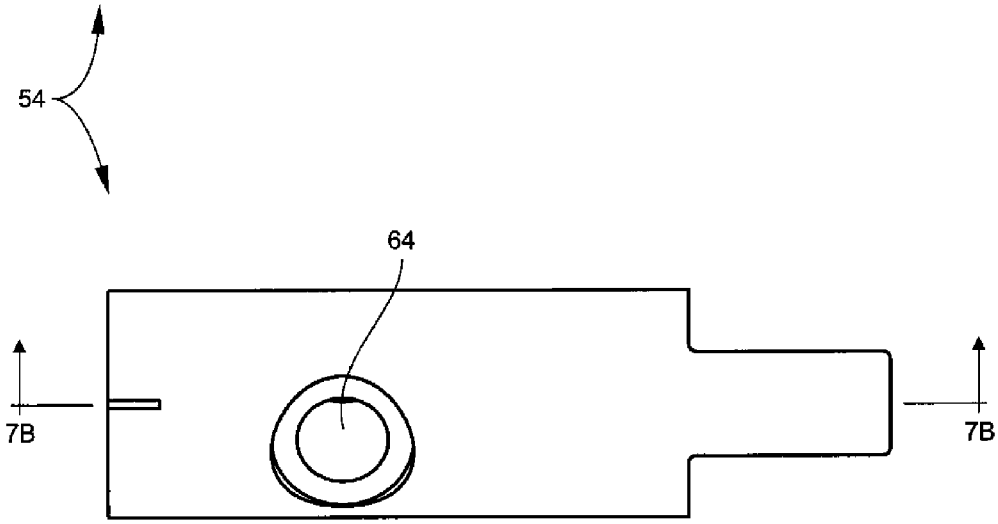
FIG. 7A is a side view of an embodiment of a fin shaft.

Base 14 (FIGS. 4A-4C) may include a slot 50 and a fin shaft opening 52 for each fin 30. Fin deployment apparatus 200 may further include a fin shaft 54 (FIGS. 3 and 7A-7B) connected to each fin 30. Fin shafts 54 may be rotatably disposed in fin shaft openings 52 in base 14. Each fin shaft 54 may include an opening 64 for housing a spring-loaded pin 58 (FIG. 8).

Figure 8:
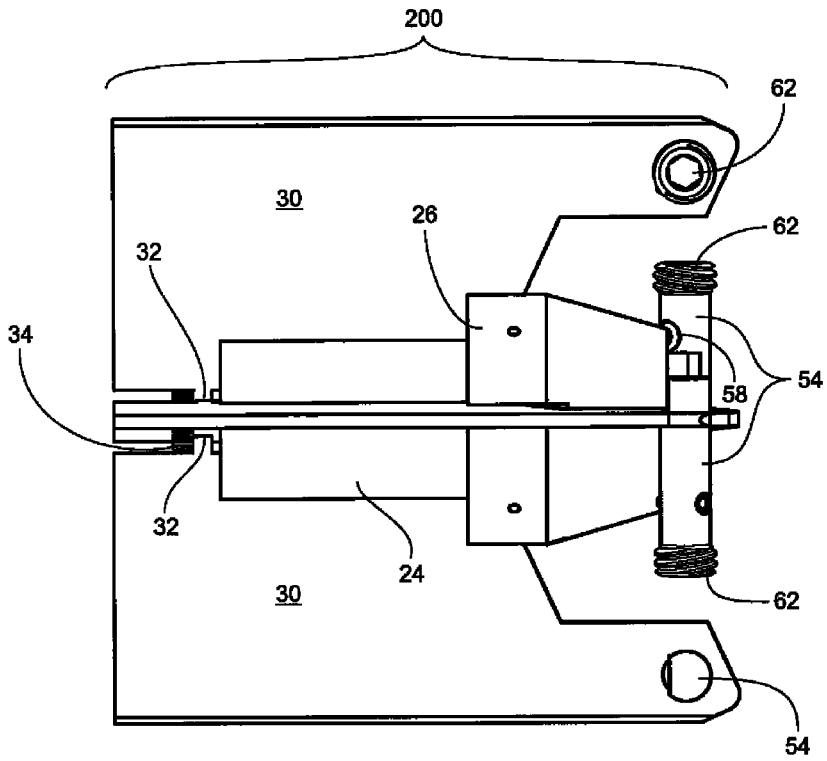
FIG. 8 is a side view of an embodiment of a fin deployment apparatus with the base removed, for clarity.

FIG. 8 is a side view of fin deployment apparatus 200 with base 14 removed, for clarity. Fins 30 are in the folded position with retention screw 34 bearing against tabs 32. Spring-loaded pins 58 are disposed in fin shafts 54. As shown in FIG. 8, set screws 62 may be disposed at one end of each fin shaft 54. Set screws 62 may threadingly engage fin shaft openings 52 (FIG. 4C) in base 14. Set screws 62 may not rotate with fin shafts 54.

After projectile 10 exits the gun muzzle, plug 24 with attached retention screw 36 may move rearward. Fins 30 may first be unlocked by movement of retention screw 36 away from tabs 32. As plug 24 moves further rearward, fins 30 may rotate outwardly around fin shafts 54. When fins 30 have completed their outward rotation (deployed position of FIG. 9), spring-loaded pins 58 (FIG. 8) may extend outwardly into recesses 66 (FIG. 4C) formed adjacent fin shaft openings 52 in base 14. Extension of the spring-loaded pins 58 into recesses 66 may lock fins 30 in the deployed position.

Another embodiment of a fin deployment apparatus 300 is shown in FIGS. 10A-D. FIGS. 10A-D are perspective, end, side, and sectional views, respectively, of fin deployment apparatus 300 with its fins 130 and fin hubs 126 in a stowed or folded position. Fin deployment apparatus 300 may be used in place of fin deployment apparatus 200 on projectile 10.

Figures 10A, 10B:
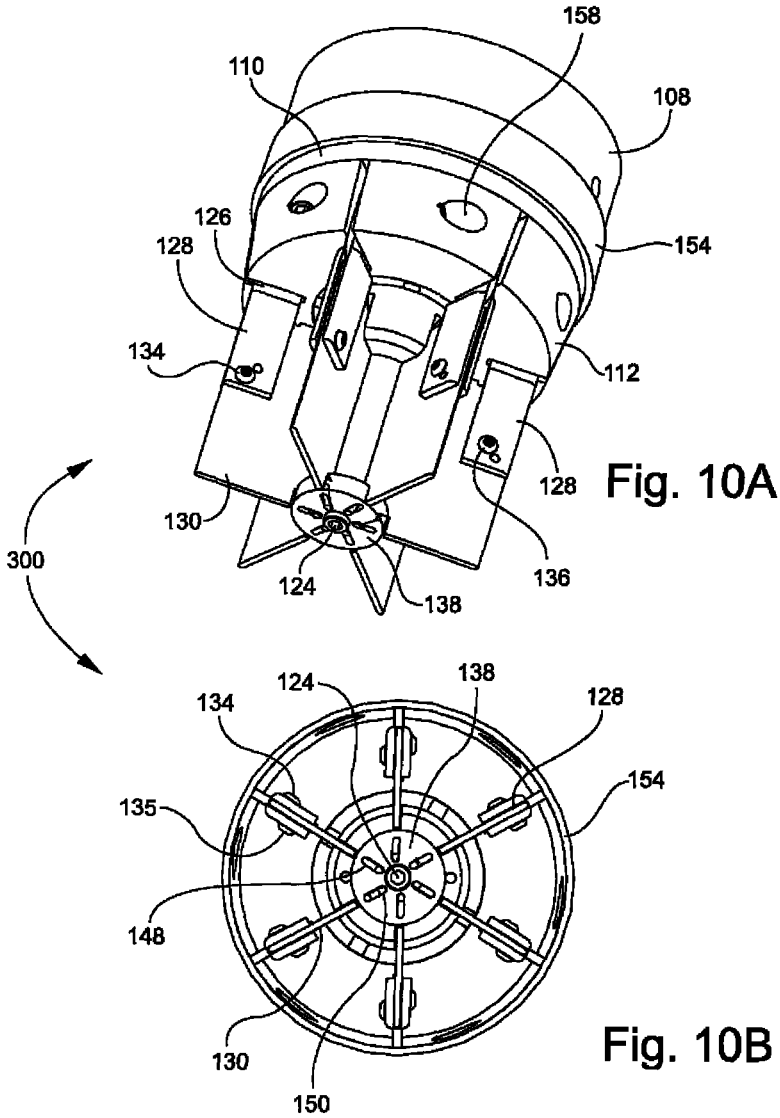
FIGS. 10A, B, C, and D are perspective, end, side, and sectional views, respectively, of another embodiment of a fin deployment apparatus, in the stowed position. The sectional view of FIG. 10D is taken through a pair of opposing fins and the longitudinal axis of the fin deployment apparatus.
Figure 10C:
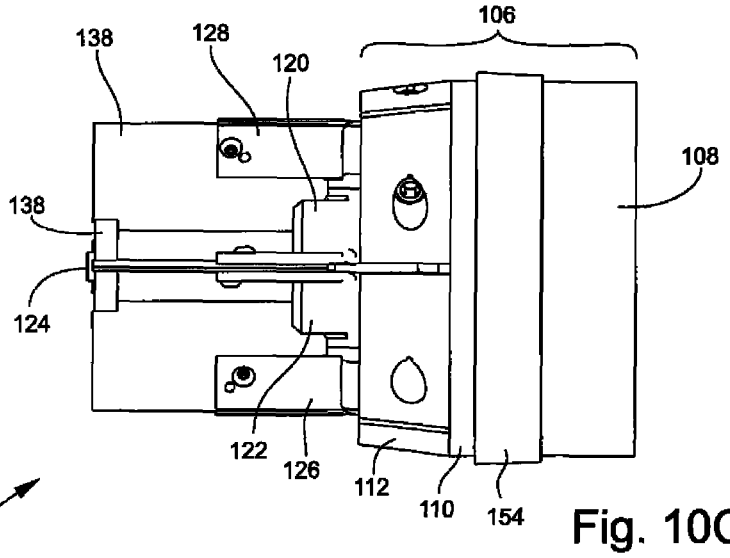

As seen in FIGS. 10C and D, apparatus 300 may include a base assembly 106. Base assembly 106 may include a base 108, a spacer 110, a fin mount 112, a gas cavity 114, and an opening 116. Opening 116 (best seen in FIG. 11C) may extend from a rear end of base 108 to gas cavity 114. A retention nut 118 may be engaged with base 108. Retention nut 118 may secure fin mount 112 and spacer 110 to base 108. A retention plug 120 may be disposed in opening 116 in base assembly 106.

An obturator groove 152 may be formed in base 108. A rear side 156 of obturator groove 152 may be defined by spacer 110. An obturator 154 may be disposed in obturator groove 152. Obturator 154 may be, for example, a solid, one-piece obturator. Assembly of obturator 154 may be easy because obturator 154 may simply slide into groove 152 from the rear of base 108. Then, spacer 110, fin mount 112, and retention nut 118 may be assembled. Complex assembly procedures used with prior art obturators, such as a shrink fit or a press fit, may not be needed with base assembly 106.

Retention plug 120 may include at least one gas conduit between an outer surface 122 of retention plug 120 and gas cavity 114. The gas conduit(s) in plug 120 may be similar to the conduits 26 (FIGS. 5A-D) of plug 24, except that the conduits in plug 120 may not be formed along the central axis of plug 120. A retention bolt 124 may extend through retention plug 120. Retention bolt 124 may be fixed to base 108.

Figure 11A:
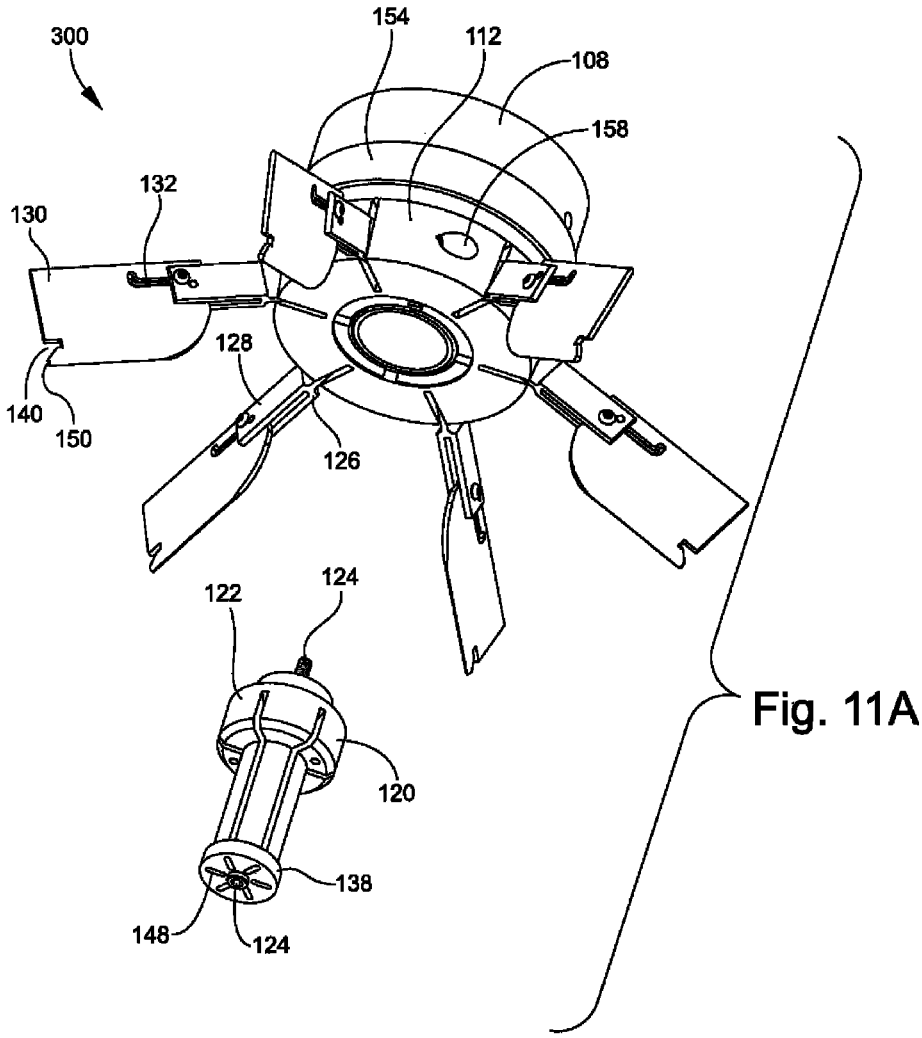
FIGS. 11A, B, and C are perspective, end, and sectional views, respectively, of the fin deployment apparatus of FIGS. 10A-D, in the deployed position. The sectional view of FIG. 11C is taken through a pair of opposing fins and the longitudinal axis of the fin deployment apparatus. The retention disk, retention plug, and retention bolt are shown after ejection from the fin deployment apparatus.
Figure 11B:
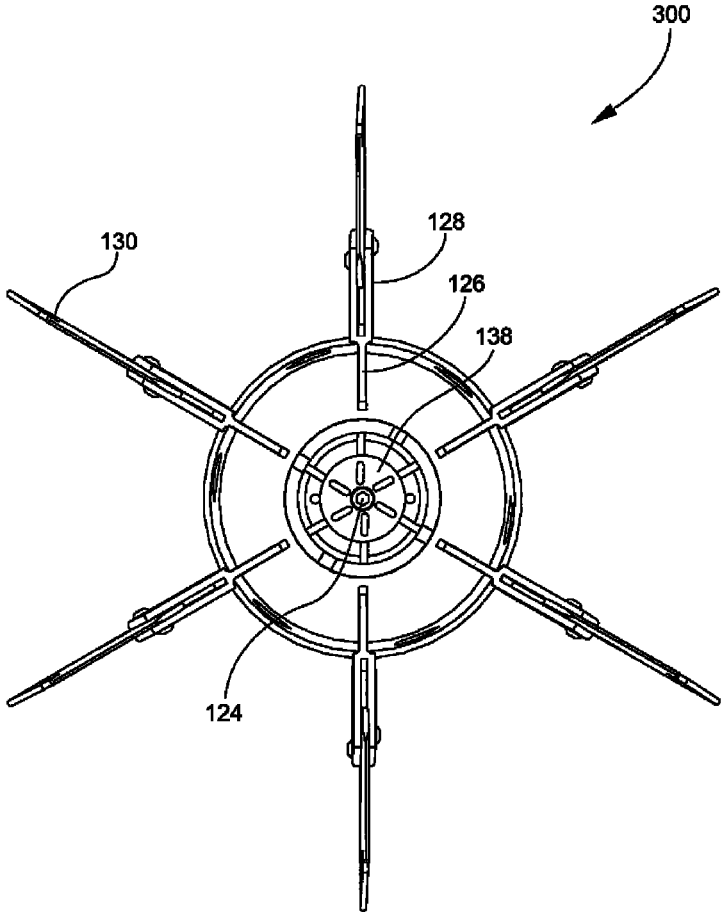
Figure 11C:
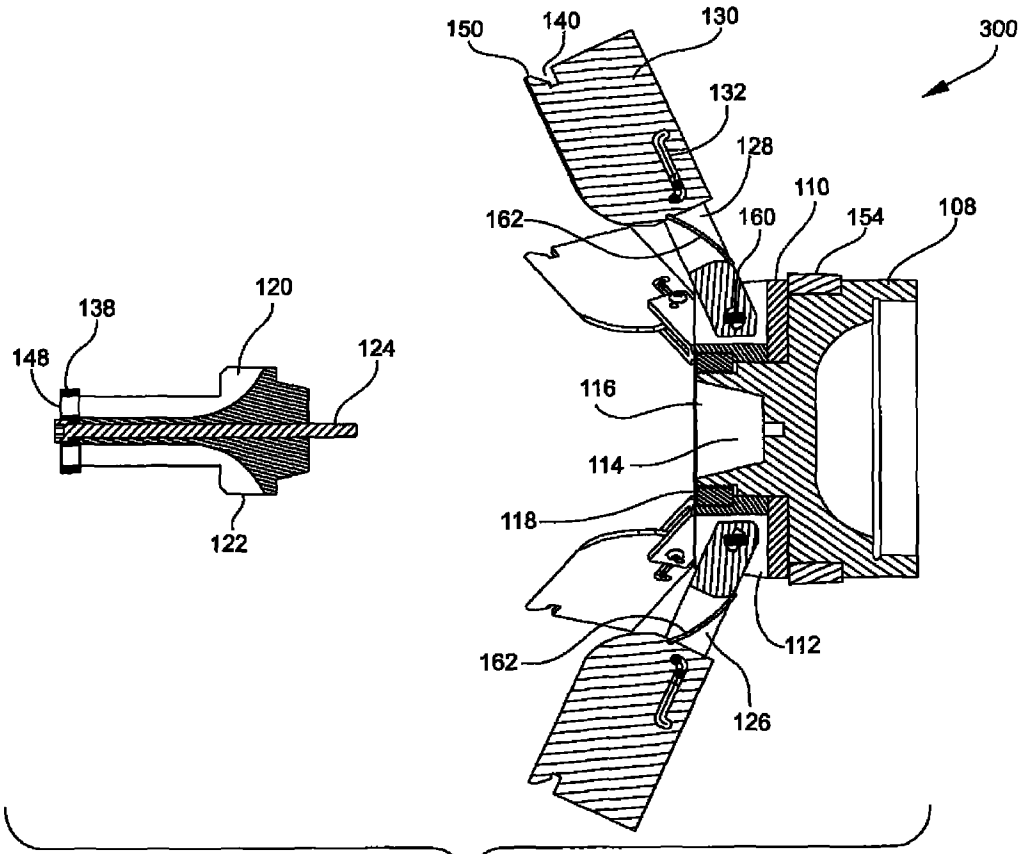
Figure 12A:
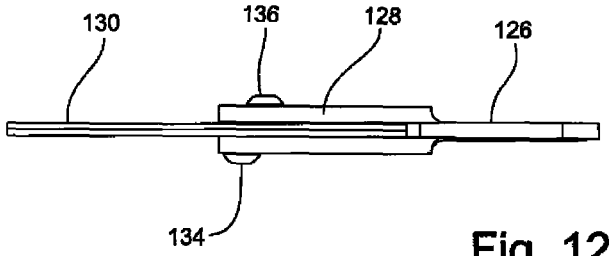
FIGS. 12A, B, and C are top, side, and sectional views, respectively, of a fin and fin hub prior to rotation and translation of the fin with respect to the fin hub.
Figure 12B:
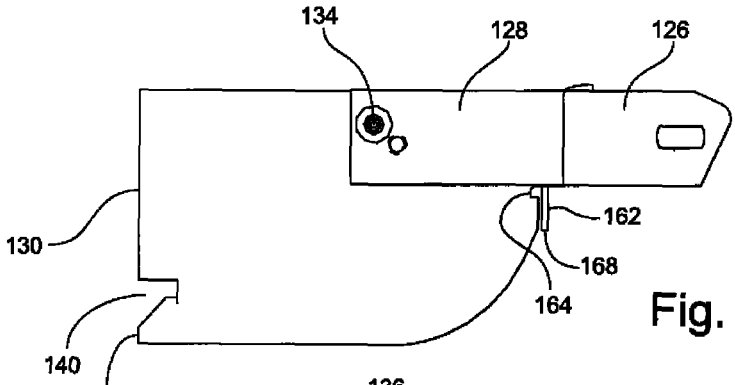
Figure 12C:
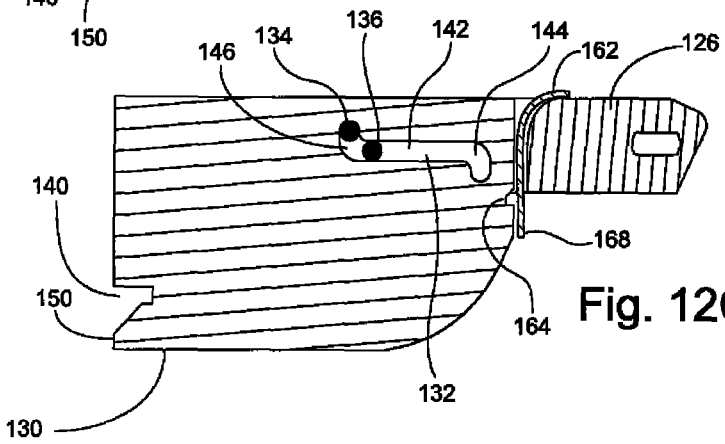

A plurality of fins hubs 126 may be rotatably fixed to base 108. Each fin hub 126 may include a yoke 128. A plurality of fins 130 may be movably connected to respective fin hubs 126. The number of fins 130 may be, for example, six. Other numbers of fins 130 may be used. After projectile 10 exits the muzzle of gun tube 100, fins 130 may deploy outwardly into the airstream (FIGS. 11A-C). In the deployed state, fins 130 may be a stabilizing device for projectile 10.

A retention disk 138 may be disposed in openings 140 (FIG. 11A) in each of fins 130. Retention disk 138 may be fixed in place by retention bolt 124. Retention disk 138 may include a plurality of slots 148 (FIG. 11A) formed therein. When fins 130 are in the stowed position, a portion 150 of each fin 130 may be disposed in a respective one of slots 148.

Fin mount 112 may include a fin shaft opening 158 (FIG. 10A) for each fin hub 126. A fin shaft 160 (FIG. 11C) may be connected to each fin hub 126. Fin shafts 160 may be rotatably disposed in fin shaft opening 158 in fin mount 112. Spring-loaded pins may be disposed in each fin shaft 160. The spring-loaded pins may be similar to spring-loaded pins 58 in FIG. 8. The spring-loaded pins may lock each fin hub 126 in the deployed position.

Figure 13A:
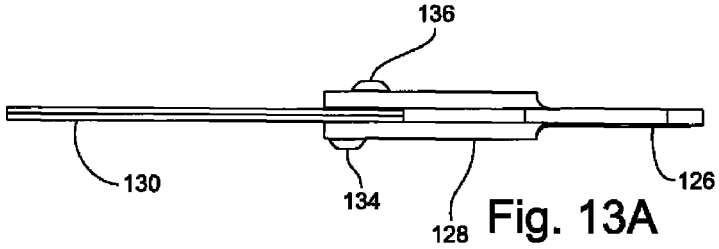
FIGS. 13A, B, and C are top, side, and sectional views, respectively, of the fin and fin hub of FIGS. 12A-C, after the fin has rotated and translated with respect to the fin hub.
Figure 13B:
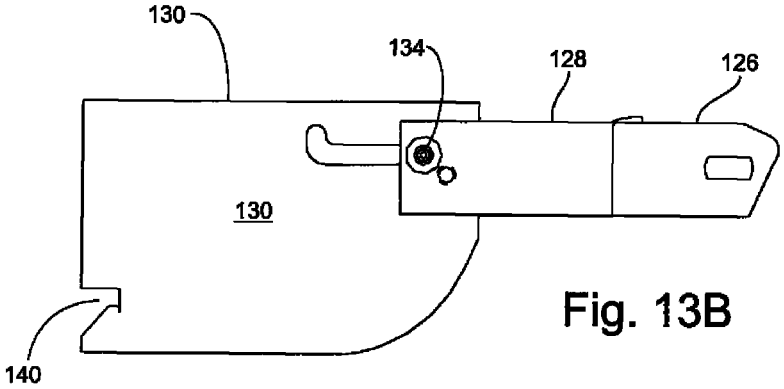
Figure 13C:
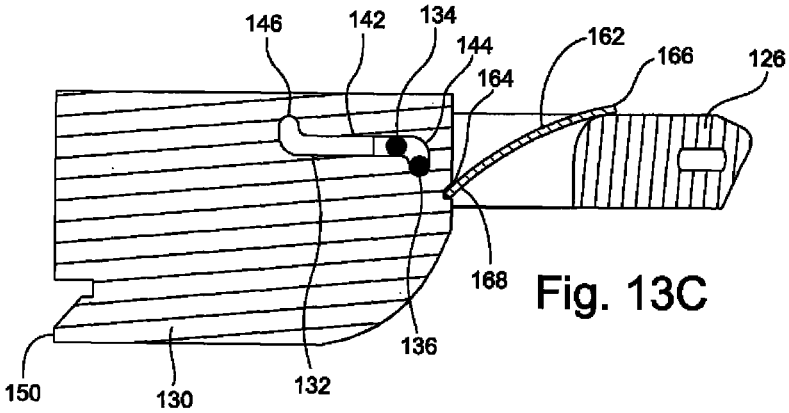

As best seen in FIGS. 12A-C and 13A-C, each fin 130 may include a slot 132 formed therein. Each fin 130 may be inserted in a yoke 128 of a fin hub 126. Each fin 130 may be connected to a respective fin hub 126 by fasteners 134, 136. Fasteners 134, 136 may be movably disposed with respect to slots 132. Fasteners 134, 136 may be fixed to yokes 128. Fin hubs 126 and fins 130 may have stowed positions (FIGS. 12A-C) and deployed positions (FIGS. 13A-C).

Each fin slot 132 may include a central portion 142 that is substantially parallel to longitudinal axis A of projectile 10 (FIG. 3) when fins 130 are in the stowed position. Each fin slot 132 may include front and rear portions 144, 146 that are substantially perpendicular to central portion 142. With respect to longitudinal axis A of projectile 10, rear portion 146 of each slot 132 may be radially distant from front portion 144 of each slot 132.

The number of fasteners 134, 136 that movably connect each fin 130 to each fin hub 126 may be, for example, two. In the stowed position of fins 130 (FIGS. 12A-C), fastener 134 may be disposed in rear portion 146 of slot 132 and fastener 136 may be disposed in central portion 142 of slot 132. In the deployed position of fins 130 (FIGS. 13A-C), fastener 134 may be disposed in central portion 142 of slot 132 and fastener 136 may be disposed in front portion 144 of slot 132.

A spring lever 162 may be disposed in each yoke 128. Spring lever 162 may have one end 166 fixed to fin hub 126 and a free end 168. Each fin 130 may include a notch 164 formed on a front surface. Free end 168 of spring lever 162 may be disposed in notch 164 when fin 130 is in the deployed position.

FIGS. 11A, B, and C are perspective, end, and sectional views, respectively, of the fin deployment apparatus 300 of FIGS. 10A-D, in the deployed position. Retention disk 138, retention plug 120, and retention bolt 124 are shown after ejection from fin deployment apparatus 300. In fin deployment apparatus 300, fins 130 not only rotate out away from projectile 10, they also extend via slots 132 thereby placing fins 130 further into the airstream. When fins 130 are further away from projectile 10, fins 130 may engage the more laminar airflow as well as possess a greater moment arm in controlling the stability of projectile 10. The greater moment arm may be critical in certain applications as it may provide the necessary center of pressure for the projectile's aeroballistic characteristics.

Figure 10D:
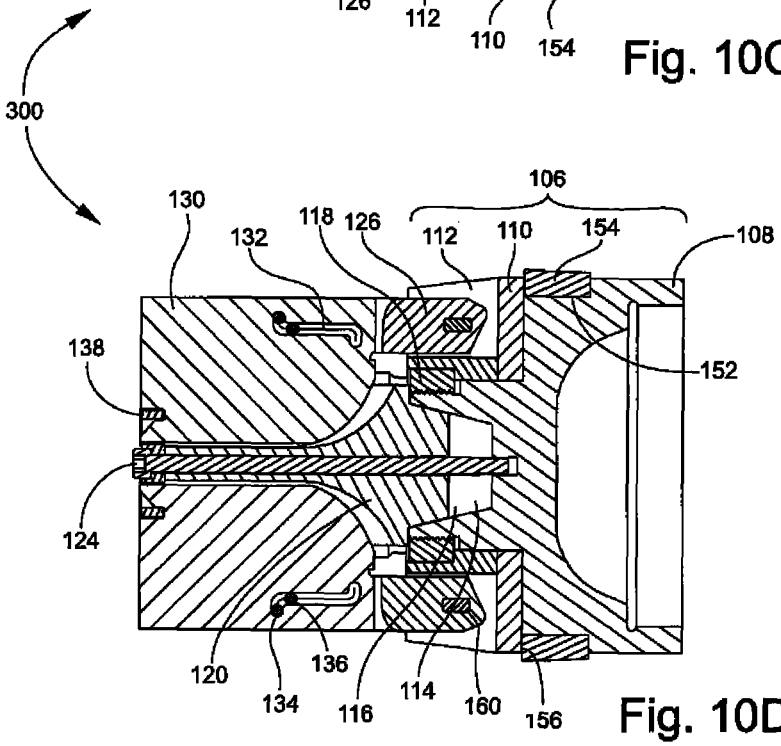

When projectile 10 with fin deployment apparatus 300 is launched, gas conduit(s) in retention plug 120 may allow burning gases into gas cavity 114 (FIG. 10D). As projectile 10 leaves gun tube 100, a pressure differential occurs such that the pressure exterior to base assembly 106 is close to atmospheric, while the pressure in gas cavity 114 is significantly higher. The pressure differential pushes on retention plug 120 and breaks retention bolt 124. Retention plug 120, retention disk 138, and retention bolt 124 may be pushed rearwardly out of opening 116, as shown in FIGS. 11A-C. Then, fins 130 may begin their deployment. During deployment, fin hubs 126 may rotate forward until fin hubs 126 contact spacer 110.

At this point, fins 130 may tilt or cock forward, thereby releasing fins 130 to freely slide through slot 132. A combination of aerodynamic drag, centripetal force, and the force of spring levers 162 may contribute to extending fins 130 outward into their deployed locking state, while also forcing fin hubs 126 rearward until free ends 168 of spring levers 162 lock in notches 164 in fins 130. As described with regard to fin deployment apparatus 200, spring-loaded pins 58 (FIG. 8) may lock fin shafts 160 at the desired angle of their deployed state.

The fin subassemblies (FIGS. 12A-C) may support their own inertial set back during launch of projectile 10, while also retaining the ability to extend fins 130 far into the airstream after projectile 10 exits gun tube 100. The generally "s"-shaped slots 132 in fins 130 enable the inertial support and extension of fins 130 far into the airstream. While projectile 10 is in gun tube 100, fins 130 may not rotate because of the restraint provided by retention disk 138. Because fins 130 do not rotate with respect to fin hubs 126, fasteners 134 may function as a translational stop in slots 132 and allow fin hubs 126 to pull fins 130 through gun tube 100. Fin hubs 126 may relieve any inertial loading that fins 130 would exert on retention disk 138, retention plug 120, and retention bolt 124.

After projectile 10 exits gun tube 100, retention disk 138 may be removed and fins 130 may rotate away from fin hubs 126. In addition, fins 130 may translate outward from fin hubs 126. Spring levers 162 may assist the translation of fins 130 with respect to fin hubs 126. As fins 130 translate fully through slots 132 and rotate back to align with fin hubs 126, fasteners 136 may lock into front portions 144 of slots 132. In addition, free ends 168 of spring levers 162 may lock in notches 164 in fins 130, thereby locking fins 130 in the deployed position.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A projectile, comprising:

a body;

a base assembly fixed to a rear end of the body, the base assembly including a base, a spacer, a fin mount, a gas cavity and an opening extending from a rear end of the base to the gas cavity;

a retention nut engaged with the base wherein the retention nut secures the fin mount and the spacer to the base;

a retention plug disposed in the opening in the base assembly, the retention plug including at least one gas conduit between an outer surface of the retention plug and the gas cavity;

a retention bolt that extends through the retention plug and is fixed to the base;

a plurality of fins hubs rotatably fixed to the base, each fin hub including a yoke; and a plurality of fins movably connected to respective ones of the plurality of fin hubs, each fin including a slot formed therein, each fin being inserted in the yoke of a respective fin hub and connected to the respective fin hub by fasteners movably disposed with respect to the slot and fixed to the yoke, wherein the plurality of fin hubs and fins have a stowed position and a deployed position.

2. The projectile of claim 1, further comprising a retention disk disposed in openings in each of the plurality of fins, the retention disk being fixed in place by the retention bolt.

3. The projectile of claim 2, wherein the retention disk includes a plurality of slots formed therein and further wherein, when the fins are in the stowed position, a portion of each fin is disposed in a respective one of the retention disk slots.

4. The projectile of claim 1, wherein each slot includes a central portion that is substantially parallel to a longitudinal axis of the projectile when the fins are in the stowed position, and front and rear portions that are substantially perpendicular to the central portion.

5. The projectile of claim 4, wherein, with respect to the longitudinal axis of the projectile, the rear portion of each slot is radially distant from the front portion of each slot.

6. The projectile of claim 4, wherein a number of the fasteners that movably connect each fin to each fin hub is two and further wherein, in the stowed position of the fins, a first of the two fasteners is disposed in the rear portion of the slot and a second of the two fasteners is disposed in the central portion of the slot.

7. The projectile of claim 6, wherein, in a deployed position of the fins, the first of the two fasteners is disposed in the central portion of the slot and the second of the two fasteners is disposed in the front portion of the slot.

8. The projectile of claim 7, further comprising a spring lever disposed in each yoke, the spring lever having one end fixed to the fin hub and a free end.

9. The projectile of claim 8, wherein each fin includes a notch formed on a front surface and further wherein the free end of the spring lever is disposed in the notch when the fin is in the deployed position.

10. The projectile of claim 1, further comprising an obturator groove formed in the base wherein a rear side of the obturator groove is defined by the spacer.

11. A method, comprising:

providing the projectile of claim 8 in a gun tube;

igniting propellant;

filling the gas cavity in the base assembly with gas produced by combustion of the propellant;

when the projectile exits the gun tube, fracturing the retention bolt and moving the retention plug out of the opening in the base assembly; and moving the fin hubs to the deployed position and translating the fins with respect to the fin hubs.

12. The method of claim 11, wherein moving the fin hubs to the deployed position includes rotating the fin hubs with respect to the fin mount and not translating the fin hubs with respect to the fin mount.

13. The method of claim 12, further comprising, after moving the fin hubs and translating the fins, locking the fin hubs in the deployed position and locking the fins in the deployed position.

14. The method of claim 11, wherein translating the fins includes moving the two fasteners through the slot.

15. A fin deployment apparatus, comprising:

a base assembly including a base, a spacer, a fin mount, a gas cavity and an opening extending from a rear end of the base to the gas cavity;

a retention nut engaged with the base wherein the retention nut secures the fin mount and spacer to the base;

a retention plug disposed in the opening in the base assembly, the retention plug including at least one gas conduit between an outer surface of the retention plug and the gas cavity;

a retention bolt that extends through the retention plug and is fixed to the base;

a plurality of fins hubs rotatably fixed to the base, each fin hub including a yoke; and a plurality of fins movably connected to respective ones of the plurality of fin hubs, each fin including a slot formed therein, each fin being inserted in the yoke of a respective fin hub and connected to the respective fin hub by fasteners movably disposed with respect to the slot and fixed to the yoke, wherein the plurality of fin hubs and fins have a stowed position and a deployed position.

16. The apparatus of claim 15, further comprising an obturator groove formed in the base wherein a rear side of the obturator groove is defined by the spacer.

17. The apparatus of claim 15, wherein each slot includes a central portion that is substantially parallel to a longitudinal axis of the projectile when the fins are in the stowed position, and front and rear portions that are substantially perpendicular to the central portion.

18. The apparatus of claim 17, wherein, with respect to the longitudinal axis of the projectile, the rear portion of each slot is radially distant from the front portion of each slot.

19. The apparatus of claim 17, wherein a number of the fasteners that movably connect each fin to each fin hub is two and further wherein, in the stowed position of the fins, a first of the two fasteners is disposed in the rear portion of the slot and a second of the two fasteners is disposed in the central portion of the slot.

20. The apparatus of claim 19, wherein, in a deployed position of the fins, the first of the two fasteners is disposed in the central portion of the slot and the second of the two fasteners is disposed in the front portion of the slot.

* * * * *